US005888017A

United States Patent [19]

Corrie

[11] Patent Number: 5,888,017

[45] Date of Patent: Mar. 30, 1999

[54] EXPANSION JOINT CAP

[75] Inventor: Dawn Corrie, Indianapolis, Ind.

[73] Assignee: Duramax, Inc., Middlefield, Ohio

[21] Appl. No.: 934,927

[22] Filed: Sep. 22, 1997

Related U.S. Application Data

[63] Continuation-in-part of Ser. No. 578,826, Dec. 26, 1995.

[51] Int. Cl.[6] ..... E01C 11/10

[52] U.S. Cl. ..... 404/64; 404/65; 52/396.04; 52/396.08

[58] Field of Search ..... 404/64, 65, 66; 52/396.04, 396.05, 396.08

[56] References Cited

U.S. PATENT DOCUMENTS

| | | | |
|---|---|---|---|
| 117,104 | 7/1871 | Northup . | |
| 2,230,688 | 2/1941 | Irwin | 404/65 |
| 2,245,633 | 6/1941 | Wolfe | 72/86 |
| 3,213,584 | 10/1965 | Bush | 52/396.08 X |
| 3,286,425 | 11/1966 | Brown | 52/396 |
| 3,508,369 | 4/1970 | Tennison | 52/396.08 |
| 3,750,359 | 8/1973 | Balzer et al. | 52/468 |
| 3,760,544 | 9/1973 | Hawes et al. | 52/468 |
| 3,971,075 | 7/1976 | Heinbaugh et al. | 4/172.19 |
| 4,067,155 | 1/1978 | Ruff et al. | 52/105 |
| 4,533,278 | 8/1985 | Corsover et al. | 404/65 |
| 4,913,576 | 4/1990 | Grant, Jr. | 403/13 |
| 4,965,976 | 10/1990 | Riddle et al. | 52/396 |
| 5,020,294 | 6/1991 | Duda | 52/573 |

FOREIGN PATENT DOCUMENTS

| | | | |
|---|---|---|---|
| 286295 | 9/1966 | Australia | 404/64 |
| 661080 | 6/1938 | Germany | 404/64 |
| 2311421 | 9/1974 | Germany | 52/396.04 |

*Primary Examiner*—James Lisehora
*Attorney, Agent, or Firm*—D. Peter Hochberg

[57] ABSTRACT

A resilient expansion joint insert member for insertion into the expansion joint between adjacent concrete floor slabs. As the concrete slabs move further apart due to settling or thermal contraction, insert member covers the widened gap. Likewise, as the concrete slabs move closer together due to settling or thermal expansion, the insert member is compressed and absorbs the force as the slabs move against each other. The flooring material on the slabs near the expansion joint move beneath a cap of the insert member.

1 Claim, 1 Drawing Sheet

EXPANSION JOINT CAP

This is a continuation-in-part of co-pending application Ser. No. 08/578,826 filed Dec. 26, 1995.

FIELD OF THE INVENTION

The present invention relates generally to an insert member, and more particularly to an expansion joint cap insert member for sealing a gap in a concrete expansion joint.

BACKGROUND OF THE INVENTION

When a concrete flooring surface is installed, a gap is ordinarily left between adjacent slabs of concrete. These gaps allow the concrete slabs room to move due to settling of a structure, and to expand and contract due to environmental temperature changes.

A typical concrete flooring surface consists of concrete slabs of large dimensions, such as by 30×30 feet square. Each slab is separated from adjacent slabs by a gap of approximately ½ inch. To provide a finished flooring surface, a flooring material such as vinyl or rubber tile is applied to the surface of the concrete slabs with the edges of the tiles even with the edges of the concrete slabs at each edge of the expansion joint. When adjacent concrete slabs contract, they separate, and they will carry the tile adhered thereto with them. If tile were laid over the crack, such as where it is filled with caulking, the tile will crack (it should not crack if it were laid up to the edge of crack of the flooring surface). Accordingly, the gap between the concrete slabs will also increase, thus causing a gap to appear between adjacent tiles applied to respective adjacent slabs of concrete. The ground may appear in the enlarged gap between the concrete slabs. In some cases, the exposed ground and enlarged gap may violate health codes. When adjacent concrete slabs expand and move closer together, the tiles adhered thereto may become damaged. In this respect, tiles adhered to adjacent concrete slabs may chip, crack, break or come unadhered from the concrete slab, as the tiles from adjacent slabs push against each other.

In view of the foregoing problems, there is a need for a device which can fill the gap between adjacent concrete slabs and prevent exposure of the gap and the underlying ground when adjacent concrete slabs move further apart, and for maintaining a generally continuous flooring surface when adjacent concrete slabs move closer.

SUMMARY OF THE INVENTION

According to a preferred embodiment of the present invention, there is provided an elongated resilient insert member of substantially constant transverse cross-section for filling an expansion joint gap formed between adjacent concrete slabs. The insert member is comprised of a cap portion having a curved upper surface and a curved lower surface, and a projection member extending downwardly from the lower surface of the cap portion. The cap portion preferably has a mushroom shape. The projection member is comprised of a pair of generally planar parallel walls, said walls generally perpendicular to said lower surface of said cap. The projection member preferably terminates in a portion having a triangular cross-section with a downward facing cross-section, like an arrowhead. The walls and lower portion thus preferably are shaped like an arrow. The arrow portion is compressed as adjacent slabs expand to narrow the gap between them. The compression is relieved when the slabs contract. The tiles or other flooring surface move beneath the mushroom cap as the slabs expand and contract.

It is an object of the present invention to provide an expansion joint cap for use in the joint between adjacent concrete flooring slabs, for enabling the movement of the slabs under the top of the cap.

It is also an object of the present invention to provide an expansion joint cap insert member for providing a continuous flooring surface between adjacent concrete slabs.

It is another object of the present invention to provide an expansion joint cap insert member which is easily installed in the gap between adjacent concrete slabs.

It is another object of the present invention to provide an expansion joint cap insert member which provides a seal between flooring materials applied to adjacent concrete slabs.

It is another object of the present invention to provide an expansion joint cap insert member which prevents chipping and cracking of flooring material applied to the surface of adjacent concrete slabs.

It is still another object of the present invention to provide an expansion joint cap insert member which covers the flooring materials applied to adjacent concrete slabs when the adjacent concrete slabs move further from each other, as during settling or thermal contraction, which could cause buckling of the flooring materials.

It is yet another object of the present invention to provide an expansion joint cap insert member which covers flooring material applied to adjacent concrete slabs, which have become damaged, such as by cracking due to a narrowing of the gap between adjacent concrete slabs, as during thermal expansion.

It is yet another object of the present invention to provide an expansion joint cap insert member which sufficiently covers the gap between two adjacent concrete slabs so that the gap remains concealed when the gap widens due to settling or thermal expansion.

A further object of the invention is to provide a joint cap which can be retrofitted into a damaged seam in concrete flooring slabs having tiles on them, to hide damage done to the slab and to the tiles, and to allow for further movement of one slab relative to another slab, or part of the slab relative to another part of the slab on opposites sides of a seam.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF THE PREFERRED EMBODIMENT

Figure 1:
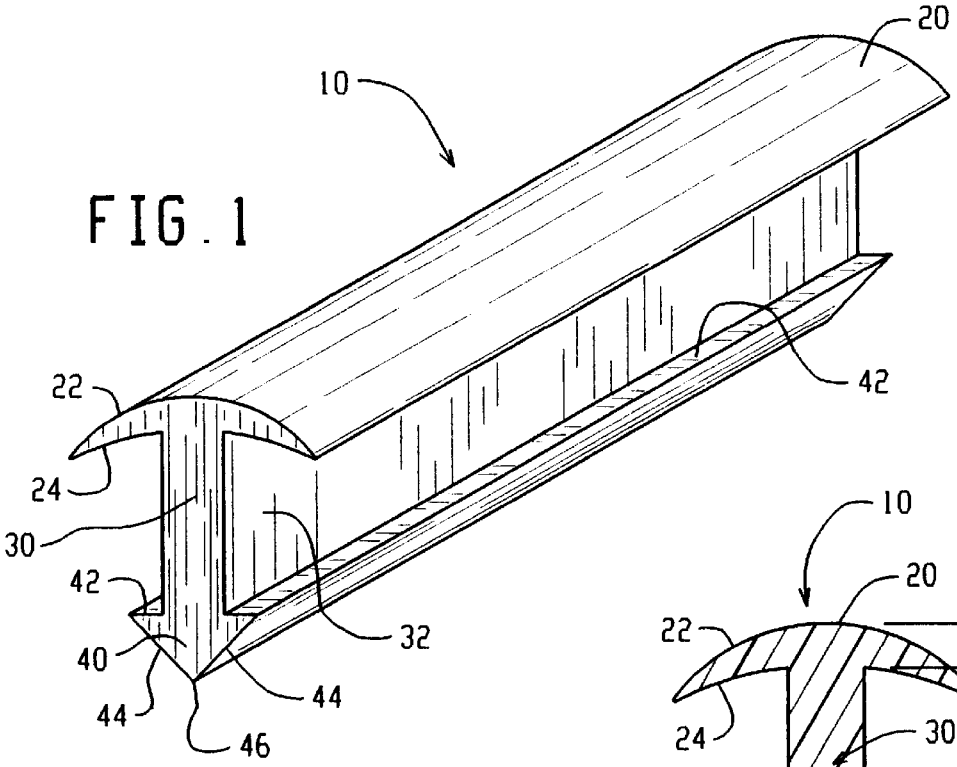
FIG. 1 is a perspective view of an expansion joint insert member illustrating a preferred embodiment of the present invention.

Referring now to the drawings wherein the showings are for the purpose of illustrating the preferred embodiment of the invention only, and not for the purpose of limiting same, FIG. 1 shows an expansion joint insert member 10 according to a preferred embodiment of the present invention. In the embodiment shown, insert member 10 is a resilient elongated strip made of an extruded vinyl or rubber material. Preferably, insert member 10 is made of an extruded thermoplastic material, such as polyvinyl chloride (PVC).

Insert member 10 is generally comprised of a cap portion 20 and a projection member 30. Cap portion 20 is generally comprised of an upper surface 22 and a lower surface 24. Upper surface 22 is a convexly curved surface, while lower surface 24 is a concavely curved surface, before insert member 10 is placed in the gap between adjacent concrete slabs. Cap portion 20 can be referred to as a mushroom cap.

Projection member 30 is generally comprised of side walls 32 and a tooth or arrowhead portion 40. Side walls 32 have a generally planar surface, and extend downward from the lower surface 24 of cap portion 20. An anchor, tooth or arrowhead portion 40 is formed at the lower end of side walls 32. Tooth portion 40 is comprised of a pair of outward extending horizontal sections 42 and a pair of angle sections 44. Horizontal sections 42 are generally perpendicular to side walls 32. Angle sections 44 have a generally planar surface. Each angle section 44 extends from the outermost edge of horizontal section 42 to a tip 46. Projection member 30 and tooth portion 40 can jointly be referred to the arrow part of member 10.

Figure 3:
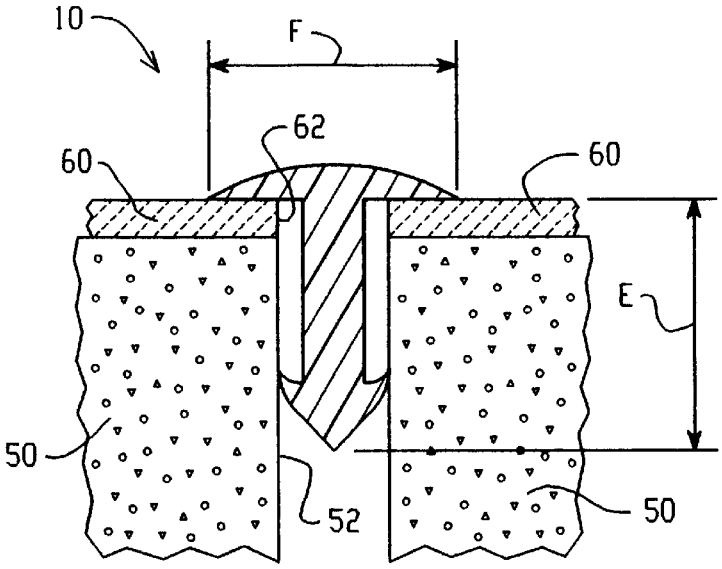
FIG. 3 is a cross-sectional view of the insert member as arranged within a gap between two adjacent concrete slabs having flooring surface materials applied thereto.

Referring now to FIG. 3, concrete slabs 50 are formed adjacent to each other with a gap 52 provided therebetween. Gap 52 typically has a width of approximately ⅛-inch to ¼-inch. Flooring materials 60 (e.g., vinyl or rubber tile) are adhered to the top surface of slabs 50 providing an extension of gap 52. Gap 52 is provided to allow for thermal expansion and contraction of concrete slabs 50, as well as movement of concrete slabs 50 due to settling.

Insert member 10 is engaged between slabs 50 and flooring material 60 by pounding insert member 10 into gap 52. The arrow part of insert member 10 is fully engaged between slabs 50 and flooring 60, and slabs 50 expand. This expansion compresses the arrow including projection member 30 and tooth portion 40, and renders lower surface 24 of cap portion 20 flush against the top surface of flooring 60. The resilience of insert member, and in particular the resilience of cap portion 20, allows cap portion 20 to spread outward as lower surface 24 meets with the upper surface of flooring 60. When insert member 10 is fully engaged, lower surface 24 will be flexed to form a generally planar surface substantially parallel to the top surface of flooring 60. The resilience of cap portion 20 provides a slight upward force on projection member 30 to exert a positive, engaging force that tends to lock projection member 30 in gap 52. Importantly, cap portion 20 extends outward from gap 52 to cover the portions of flooring 60 which meet the edge of gap 52. In most cases involving new construction, flooring 60 extends up to, but not across, the gap between slabs 50.

When slabs 50 contract, the slabs move away from projection member 30, although they usually remain engaged with anchor portion 40. There may be an air space between projection member 30 and the vertical edges of slabs 50. The flooring surface slides beneath the mushrooms or cap 20 as the slabs expand and contract.

Horizontal portions 42 of tooth portion 40 extend outward from the surfaces of side walls 32 a sufficient distance to engage with the side walls of concrete slabs 50. Angle sections 44 allow for easy installment of insert member 10 within gap 52. While the shape and size of angle sections 44 allow for easy installation, the shape and size of horizontal portion 42 provides a secure, tight fit within gap 52 and prevents easy removal of insert member 10 therefrom.

The length of insert member 10 may vary. In this regard, insert member 10 may be provided in units of varying length and cut to a size required in a particular situation. However, it will be appreciated that a length of 5, 10, 12, 15 or 30 feet may be preferred, since concrete slabs are typically formed with dimensions of 30 feet×30 feet, although 12 foot lengths are the usual dimensions for extrusions in flooring materials.

Figure 2:
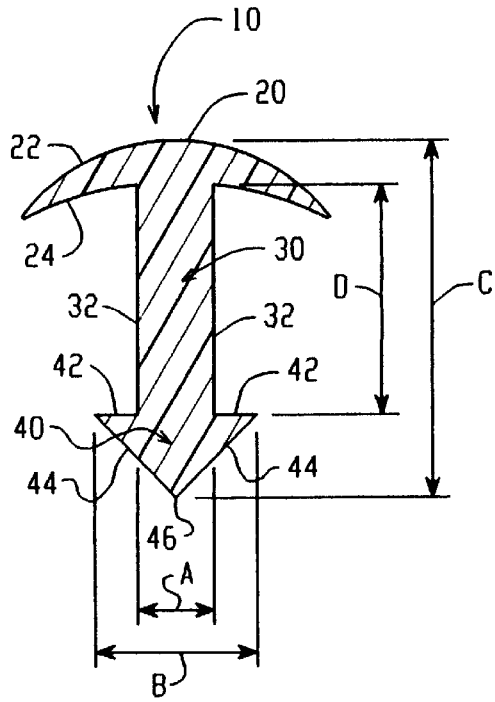
FIG. 2 is a cross-sectional view of the insert member shown in FIG. 1.

The preferred dimensions of insert member 10 will now be described with reference to FIGS. 2 and 3. Referring to tooth portion 40 shown in FIG. 2, width dimension A is approximately 0.375 inches, while width dimension B between distal ends of horizontal sections 42 is approximately 0.75 inches. Height dimension C from the center of upper surface 22 of cap portion 20 to tip 46 is approximately 1.69 inches. Side walls 32 have a preferred height dimension D of approximately 1.125 inches.

With reference now to FIG. 3, the height dimension E, from lower surface 24 to tip 46, is approximately 1.5 inches. Width dimension F of cap portion 20 is approximately 1.5 inches. It should be noted that the dimensions shown with reference to FIG. 3, are determined with insert member 10 fully engaged between slabs 50 and flooring materials 60. Accordingly, due to the resilient nature of insert member 10, cap portion 20 is spread out such that lower surface 24 is flush against flooring materials 60. Therefore, dimensions E and F will differ when cap portion 20 is not engaged. In particular, dimensions E and F will be reduced when cap portion 20 is disengaged from gap 52.

It should be appreciated that the foregoing dimensions are for a preferred embodiment only, and that any one of the dimensions may be varied to adapt insert member 10 for a particular situation.

As noted above, the present invention provides an expansion joint cap insert member for filing the gaps or seams between concrete slabs to make unnoticeable the shifting of concrete slabs of floors. The concrete slabs may move apart due to the settling of a building or due to thermal contraction. Accordingly, the insert member of the present invention are driven into the gap between the slabs to cover the flooring materials after they have moved apart. In contrast, if the concrete slabs move closer together due to settling or thermal expansion, the insert member of the present invention will be compressed and prevent chipping, buckling or otherwise damaging flooring material, as well as making any changes to the condition of the flooring material unnoticeable.

In some instances gaps may form in slabs as the slab has shifted, which could damage tiles located on the slab. Gaps could also form in a slab which has cracked, when the slab had tiles positioned on the slab. Likewise, slabs which expand against each other, or parts of a slab on opposite sides of a seam, could expand against or butt against each other. The slabs or parts of slabs which initially butt against each other could contract and form a gap. The foregoing gaps can be cleaned out, and expansion joint caps according to the invention could be retrofitted into the gaps to hide the damage and still enable further movement between contiguous slabs or parts of a slab.

It should be appreciated that the insert member of the present invention can be made of various colors so that they match or harmonize with existing colored flooring materials.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

The invention claimed is:

1. A unitary, elongated resilient insert member of substantially constant transverse cross-section for filling an expansion joint gap formed between adjacent concrete flooring slabs, said insert member consisting essentially of:

a cap portion having a convexly curved upper surface and a concavely curved lower surface, said lower surface of said cap portion forming a substantially planar surface generally parallel and adjacent to the surface of said adjacent concrete slabs, when said insert member is arranged in said expansion joint; and a projection portion integral with said cap portion extending downwardly from the lower surface of said cap portion to a lower end, said projection member consisting of:

parallel, planar opposed walls extending perpendicular to said lower surface of said cap, an anchor portion having a pair of horizontal planar surfaces, each horizontal surface extending perpendicular to and in opposite directions from the walls, to respective outer edges, and planar angle surfaces extending respectively from the outer edges of the horizontal surfaces to a common point at the lower end of the projection members, said walls and said anchor portion having the shape of an arrow;

wherein the resilience of said cap portion provides a slight upward force on said projection member to exert a positive, engaging force that tends to lock said projection member in said gap.

* * * * *